United States Patent [19]

Itoh et al.

[11] Patent Number: 4,860,048

[45] Date of Patent: Aug. 22, 1989

[54] IMAGE FORMING APPARATUS

[75] Inventors: Masahiro Itoh, Yokohama; Yoshihiro Murasawa, Kawasaki; Atsushi Takeda; Hiroaki Tsuchiya, both of Yokohama; Kimio Nakahata, Kawasaki, all of Japan

[73] Assignee: Canon Kabushiki Kaisha, Tokyo, Japan

[21] Appl. No.: 199,278

[22] Filed: May 26, 1988

[30] Foreign Application Priority Data

May 28, 1987 [JP] Japan ..... 62-132914

[51] Int. Cl.[4] ..... G03G 15/01

[52] U.S. Cl. ..... 355/208; 355/214; 355/246; 355/326; 346/157

[58] Field of Search ..... 355/4, 14 R, 14 CH, 355/140; 346/157

[56] References Cited

U.S. PATENT DOCUMENTS 4,791,452 12/1988 Kasai et al. ..... 355/14 D

FOREIGN PATENT DOCUMENTS 56-106265 8/1981 Japan .
58-116553 7/1983 Japan .
60-46575 3/1985 Japan ..... 355/4
61-190354 8/1986 Japan ..... 355/4

*Primary Examiner*—Arthur T. Grimley

*Assistant Examiner*—J. Pendegrass

*Attorney, Agent, or Firm*—Fitzpatrick, Cella, Harper & Scinto

[57] ABSTRACT

An image forming apparatus includes movable image bearing member, a first charger means for charging the image bearing member, first electrostatic latent image forming device for forming a first electrostatic latent image in accordance with image information on the image bearing means charged by the first charger, first developing device for developing the first electrostatic latent image, a second charger for re-charging the image bearing member, second electrostatic latent image forming device for forming a second electrostatic latent image in accordance with image information on the image bearing member recharged by the second charger, second developing device for developing the second electrostatic latent image, a dector for detecting a surface potential of the image bearing member, the detector detecting at least the surface potential at that portion of the latent image formed on the image bearing member by the first latent image forming device which is developed, after the portion is charged by the second charger, and a controller for controlling the second charger to provide a target potential of the portion and for controlling a developing bias voltage of the second developing device in accordance with the potential of the portion.

31 Claims, 4 Drawing Sheets

IMAGE FORMING APPARATUS

FIELD OF THE INVENTION AND RELATED ART

The present invention relates generally to an image forming apparatus provided with a plurality of image forming means for forming electrostatic latent images on an image bearing member and visualizing the electrostatic latent images to form a plurality of images in combination, more particularly to a multi-color image forming apparatus of an electrophotographic type provided with a plurality of image forming means each comprising at least charging, image exposure and developing means to form a color image at least in two colors.

Various multi-color image forming machines of an electrostatic recording type or an electrophotographic type for providing multi-color or full-color images have been proposed.

Referring first to FIG. 4, a two-color electrophotographic apparatus is shown which comprises two sets of image forming means each comprising a charger, an exposure means and a developing means to provide a two-color image. As shown in FIG. 4, the two-color electrophotographic apparatus includes an image bearing member, more particularly, an electrophotographic photosensitive member 1 in the form of a drum, rotatable in the direction indicated by an arrow. Around the photosensitive drum 1, there are provided a first image forming means including a charger 2, an exposure device 3 and a developing device 4; a second image forming means including a charger 5, an exposure device 6 and a developing device 7; and in addition, a transfer charger 8, a cleaning means 9 and a pre-exposure means 10.

In the first image forming means, the photosensitive drum 1 is charged by the charger 2 to a potential $Vd_1$, as shown in FIG. 5, and then is exposed to image light bearing first image information by the first exposure device 3, by which the potential of the portion exposed to the light becomes $Vl_1$ so that a first latent image is formed. Subsequently, the first latent image is reversely developed by the first developing device 4, so that a first color image (red, for example) is formed.

Then, in the second image forming means, the photosensitive drum 1 is re-charged by the charger 5, by which the potential of the portion exposed by the first image forming means becomes $Vl_2$, and the potential of the unexposed potential becomes $Vd_2$. Subsequently, the photosensitive drum 1 is exposed by the second exposure device 6 to a light image bearing second image information, by which the potential of the exposed portion becomes $Vl_3$, so that a second latent image is formed. The second latent image is reversely developed by the second developing device 7, so that a second color image (black, for example) is formed.

Thereafter, the first and second color images are simultaneously transferred onto a transfer sheet P by a transfer charger 8, and the transferred image is fixed by heat and pressure by a fixing device (not shown). On the other hand, the residual toner remaining on the photosensitive drum 1 is removed by the cleaning means. The photosensitive drum 1 is further electrically discharged by the pre-exposure means 10, by which a series of image forming operations terminates.

However, in an image forming apparatus of such a structure, an electric potential contrast of the electrostatic latent image formed on the photosensitive drum varies with time of use or variation in the ambient conditions, with the result of image density variation, mixture in color, foggy background or the like.

SUMMARY OF THE INVENTION

Accordingly, it is a principal object of the present invention to provide an image forming apparatus which is not influenced by variations in the ambient conditions or by the time of use and which can always provide a high quality image, particularly to a multi-color image forming apparatus which can provide a high quality image without mixture in color.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
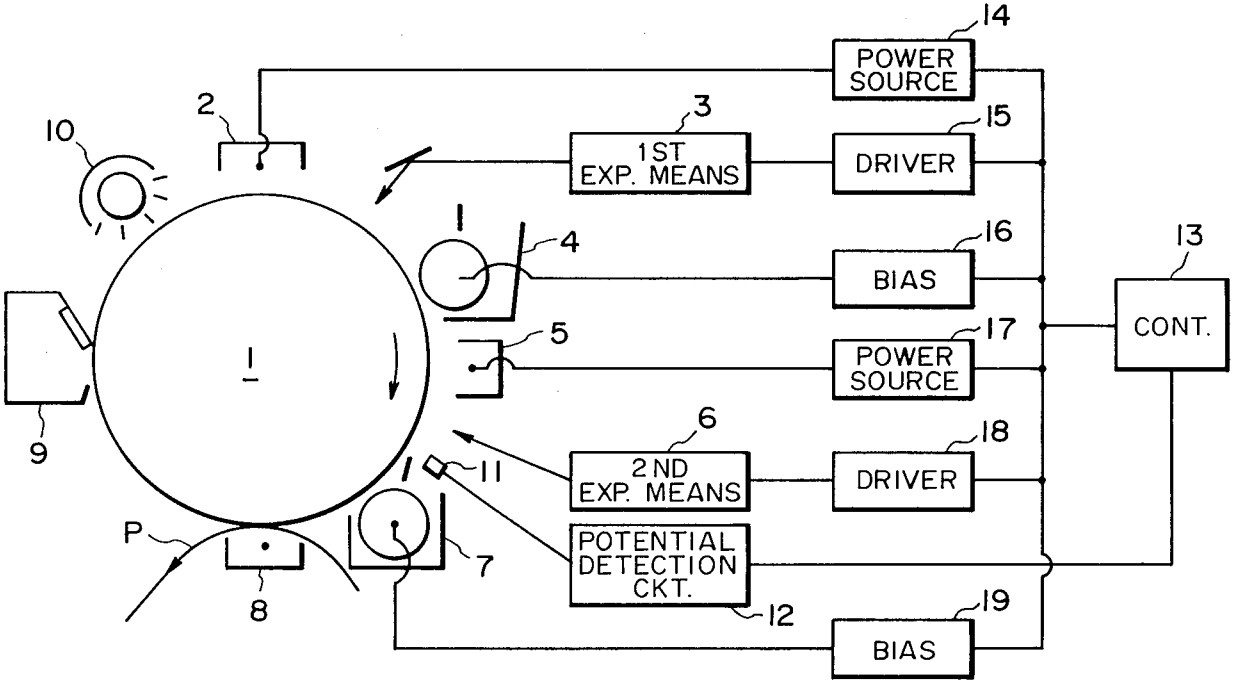
FIG. 1 is a sectional view of an image forming apparatus according to an embodiment of the present invention.
Figure 4:
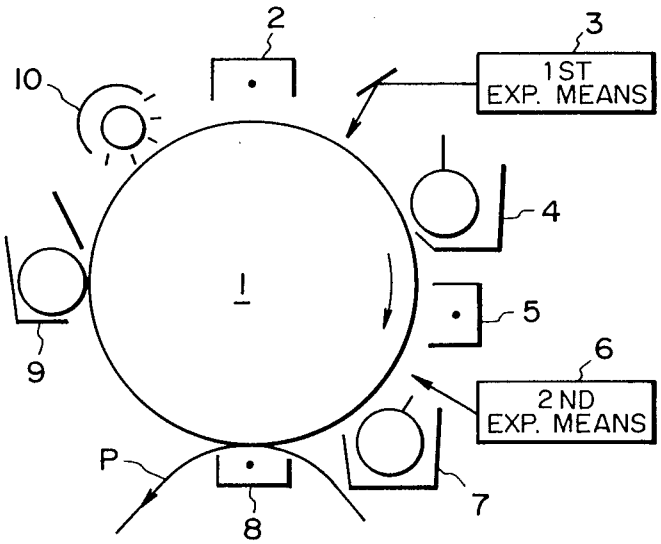
FIG. 4 is a sectional view of a two-color image forming apparatus to which the present invention is applicable.

Referring now to FIG. 1 there is shown an image forming apparatus according to an embodiment of the present invention. The exemplary image forming apparatus is of a two-color electrophotographic apparatus capable of forming a two-color image. The general arrangement of the apparatus is similar to that of the two-color electrophotographic apparatus shown in FIG. 4, and therefore, the detailed description thereof is omitted by assigning the same reference numerals to the corresponding elements.

The apparatus of this embodiment is provided, between a charger 5 and a developing device 7 of a second image forming means, with a potential sensor 11 for detecting a surface potential of a photosensitive drum 1 and with a potential detecting circuit 12 connected to the potential sensor 11. The output signal of the potential detecting circuit 12 is transmitted to a control circuit (control means) 13. The control circuit 13 serves to control a power source 14 for the first charger 2, driving means 15 for a first exposure device, a power source 17 for a second charger 5, driving means 13 for a second exposure device 6, a bias source 16 for a first developing device 4 and a bias source 19 for a second developing device 7.

Here, the first and second developing devices contain different color developers.

In this embodiment, the first exposure device 3 and the second exposure device 6 each comprise a laser beam scanning means for projecting a laser beam modulated in accordance with image information onto the photosensitive drum 1. In this embodiment, the photosensitive drum 1 is of an OPC (organic photoconductor) material.

In the image forming apparatus of such a structure, a charged potential by the charger, a potential of an electrostatic latent image formed by the image exposure, a developing bias voltage or the like are set, not during image forming operation, but they are set for example, during a warming period after the main switch of the image forming apparatus is actuated, by the control circuit 13. On the basis of the data obtained during such a period, the control circuit 13 controls the image forming means during the image forming operation so as to provide a target potential and a target developing bias voltage.

Figure 2:
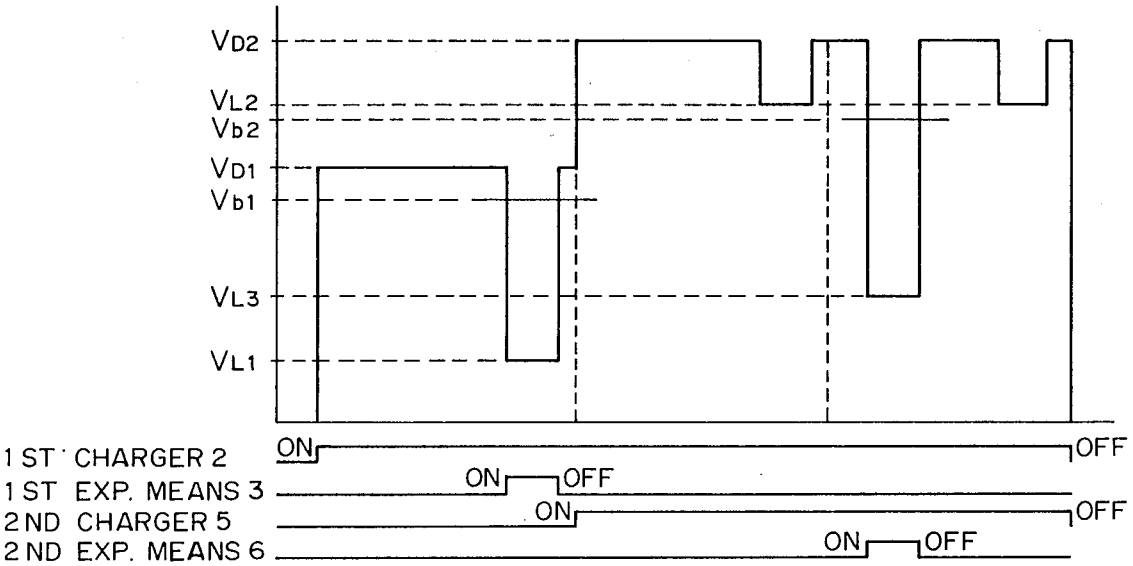
FIG. 2 is a graph of change of a surface potential of an image bearing member in the apparatus of the first embodiment shown in FIG. 1.
Figure 3:
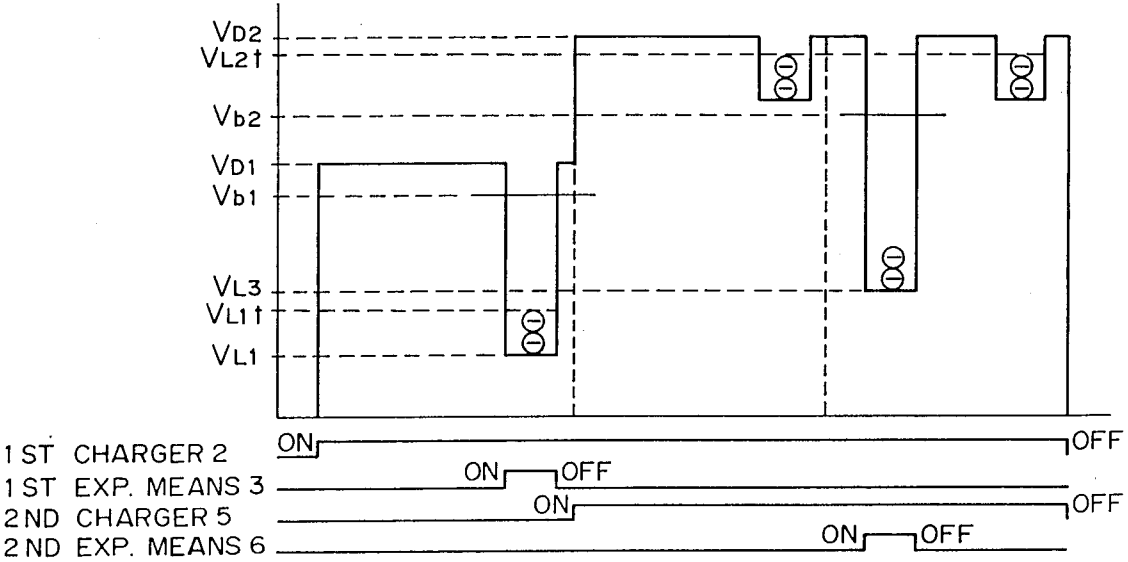
FIG. 3 is a graph of change of a surface potential of an image bearing member of the apparatus according to a second embodiment.
Figure 5:
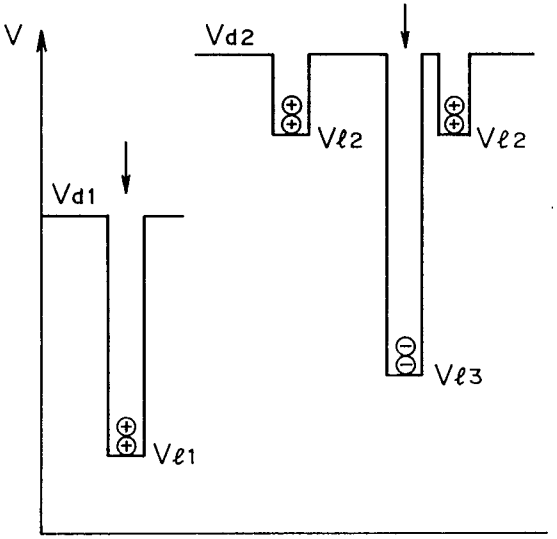
FIG. 5 is a graph of change of a surface potential of an image bearing member of the apparatus shown in FIG. 4 during image forming operation.

Referring to FIGS. 1 and 2, this will be described in detail.

The photosensitive drum 1 is rotated in the direction indicated by an arrow, and is charged by the first charger 2 to provide a target dark portion potential $V_{D1}=-500$ V. For this operation, the surface potential of the photosensitive drum 1 is detected by the potential sensor 11, in response to which the control circuit 13 performs control operation to provide the potential. The photosensitive drum 1 is exposed to image light by the first exposure device 3 to provide a target light portion potential $V_{L1}=-100$ V (the portion exposed to light) in the similar manner.

On the basis of a dark portion potential $V_{D1}$ and the light portion potential $V_{L1}$ thus controlled, a proper developing bias voltage ($V_{b1}=-400$ V in this case) is determined for the first developing device 4. The developing bias voltage $V_{b1}$ is applied to a developing sleeve of the first developing device 4, which carries a developer charged to a negative polarity, in this embodiment.

After a first color latent image is formed on the photosensitive drum 1, with the above described potential, the second latent image is formed. Upon the second latent image formation, the whole surface of the photosensitive drum 1 is re-charged by the second charger 5 in order to prevent unintended removal of the first color toner image and mixture of the second color toner into the first color toner image during the second image forming operation. By the re-charging, the first portion light potential $V_{L1}$ corresponding to the toner image of the first color is increased. However, if the amount of re-charge by the second charger 5 is large, the photosensitive drum 1 is broken, or fatigue of the photosensitive drum 1 is promoted. Therefore, it should be controlled to be proper.

On the other hand, the developing bias voltage $V_{b2}$ of the second developing device 7 is controlled by a control circuit 13 to be a proper level between the light portion potential $V_{L2}$, after the recharging, of the portion exposed to light by the first exposure device 3 and a light portion potential $V_{L3}$ of the portion exposed to light by the second exposure device 6. However, from the standpoint of avoiding the mixture of the first and second colors, the relationship between the second developing bias voltage $V_{b2}$ and the light portion potential $V_{L2}$ after recharging during the image forming operation is important.

This is because if $V_{b2}>V_{L2}$, the tendency of the second color toner being deposited onto the first color toner increases, and on the contrary if the bias voltage $V_{b2}$ is too small as compared with the potential $V_{L2}$, the tendency of the first color toner (developed image) being mixed into the second developing device 7 increases.

In consideration of the above, in this embodiment, the potential $V_{L2}$ is detected by the potential sensor 11, in response to which the control circuit 13 control the amount of re-charging by the second charger 5 to be a target potential of $V_{L2}=-600$ V; and further, in response to the potential $V_{L2}$, the second developing bias voltage $V_{b2}$ is determined. In this embodiment, the second developing bias voltage $V_{b2}$ equals to $-550$ V. It is further preferable from the standpoint of providing a sufficient image density of the second color image that the control circuit 13 controls the second exposure device 6 to provide a development contrast (difference, in an absolute value, between a potential of the developing bias voltage (sleeve potential) and a potential of the portion of the latent image that is to be developed, i.e., that is to receive the toner) to be 350 V, for example; the second light portion potential $V_{L3}$ to be $-200$ V; and the developing bias voltage is controlled in accordance with the potential $V_{L3}$.

By controlling the second developing bias voltage $V_{b2}$ in accordance with the light portion potential $V_{L2}$ after the recharging which is controlled to the a target potential in this manner, the color mixture can be prevented. Further, by controlling the second developing bias voltage $V_{b2}$ in consideration of the potential $V_{L2}$ so controlled and the light portion potential $V_{L3}$ provided by the second exposure device 5, the image density in the second color can be sufficiently assured. Here, the second developing bias voltage $V_{b2}$ is applied to a developing sleeve for carrying a negatively charged developer of the second developing device 7.

A further preferable embodiment will be described, wherein in order to effect the control more closely to the actual image forming operation, after the first latent image formation, the first light potential $VL_{L1}$ portion is developed by a first developing device 4; then, the photosensitive member 1 is recharged by the second charger 5; and after the second latent image formation, the second light portion potential $V_{L3}$ portion is developed by a second developing device 7.

First, the portion which has been exposed to light by the first exposure device 3 and which has a light portion potential $V_{L1}=-100$ V, is developed by the first developing device 4, thus providing a toner portion potential $V_{L1t}$. As an example, the potential $V_{L1t}$ is approximately $-150$ V.

Then, the entire latent image including the toner portion potential $V_{L1t}$ area is recharged by the second charger 5. On the other hand, the change of the toner portion potential $V_{L1t}$ is detected by the potential sensor 11. The control circuit 13 controls the amount of charging by the second charger 5 so that the potential $V_{L2t}$ which is the potential at the toner portion after the recharging becomes $V_{L2t}=-630$ V (target potential). In accordance with the toner portion potential $V_{L2t}$ after the recharging, the second developing bias voltage $V_{b2}$ of the second developing device b is determined. In this embodiment, the bias voltage $V_{b2}=-580$ V.

Further, in order to provide a sufficient image density in the second color, it is preferable that the control circuit 13 controls the second exposure device 6 so as to provide a development contrast of approximately 380 V, and that the second light portion potential $V_{L3}$ becomes equal to $-200$ V; and in accordance with the potential $V_{L3}$, the developing bias voltage is controlled. The portion having the potential $V_{L3}$ is developed by the second developing device 7 with this developing bias voltage.

The first developing bias voltage $V_{b1}$ of the first developing device 4, similarly to the case of FIG. 2, is determined on the basis of the dark portion potential $V_{D1}$ of −500 V and a light portion potential $V_{L1}$ of −100 V, that is, $V_{b1}$ equals to −400 V.

Since, as described, the second developing bias voltage $V_b$ is controlled in accordance with the toner portion potential $V_{L2t}$ (after the recharging) controlled to be a target potential, the color mixture can be prevented, and in addition, the control can be made with the state more closely to the actual image forming operation. Furthermore, the second developing bias voltage $V_{b2}$ is controlled in consideration of the potential $V_{L2t}$ and the light portion potential $V_{L3}$ by the second exposure device 6, the image density of the second color image can be sufficiently assured.

In the embodiments described above, the latent image formed by the first and second exposure devices during non-actual image forming operation, is a latent image formed in accordance with a reference image prepared beforehand in a memory means of the image forming apparatus.

The foregoing description has been made with respect to the case where the portion of the photosensitive drum exposed to light is reversely developed to provide a positive image, but this is not limiting, and the present invention is applicable when the portion not exposed to the light is developed in a regular development to provide a positive image. In this case, however, what is important is the dark portion potential (unexposed portion potential), rather than the light portion potential, as contrasted to the foregoing embodiments. In any event, the potential at the portion which receives the toner by development is considered.

Although the foregoing description has been made as to the two-color image recording, the present invention is applicable to more than three color image forming apparatus or to a full-color image forming apparatus.

As for the second charger, a charging device having a grid electrode, in which the voltage applied to the grid electrode is controlled to control the recharging.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

movable image bearing means;

first charging means for charging said image bearing means;

first electrostatic latent image forming means for forming a first electrostatic latent image in accordance with image information on said image bearing means charged by said first charging means;

first developing means for developing the first electrostatic latent image;

second charging means for re-charging said image bearing means;

second electrostatic latent image forming means for forming a second electrostatic latent image in accordance with image information on said image bearing means re-charged by said second charging means;

second developing means for developing the second electrostatic latent image;

detecting means for detecting a surface potential of said image bearing means, said detecting means detecting at least the surface potential at that portion of the latent image formed on said image bearing means by said first latent image forming means which is to be developed, after the portion is charged by said second charging means; and control means for controlling said second charging means to provide a target potential of said portion and for controlling a developing bias voltage of said second developing means in accordance with the potential of said portion.

2. An apparatus according to claim 1, wherein said control means further controls the developing bias voltage of said second developing means on the basis of a potential at that portion of the latent image formed on said image bearing means by said second electrostatic latent image forming means which is developed.

3. An apparatus according to claim 1 or 2, wherein said first and second electrostatic latent image forming means project pieces of light information in accordance with respective pieces of image information onto said image bearing means to form the electrostatic latent images.

4. An apparatus according to claim 3, wherein said pieces of light information are provided by laser beams modulated in accordance with the pieces of image information.

5. An apparatus according to claim 3, wherein said first and second electrostatic latent image forming means project light to that portion of said image bearing means which is to be developed, and wherein said first and second developing means performs reverse development wherein that portion of said image bearing means which is exposed to light is developed.

6. An apparatus according to claim 5, wherein the light is a laser beam modulated in accordance with image information.

7. An apparatus according to claim 5, said detecting means detects the potential of the portion exposed to the light by said electrostatic latent image forming means.

8. An apparatus according to claim 1, wherein said first charging means and said second charging means effect charging to the same polarity.

9. An apparatus according to claim 1, wherein said first charging means, a first latent image forming station for forming the latent image by said first electrostatic latent image forming means, said first developing means, said second charging means, a second latent image forming station for forming the latent image by said second electrostatic laten image forming means and said second developing means are disposed around said image bearing means in the order named.

10. An apparatus according to claim 9, wherein said image bearing means includes a rotatable member having an outer periphery movable along an endless path.

11. An apparatus according to claim 9, wherein said detecting means is disposed between said second latent image forming station and said second developing means.

12. An apparatus according to claim 1, wherein said first and second developing means contain different color developers, said apparatus further comprising transfer means for transferring first and second developed images onto a transfer material, wherein the first and second images are simultaneously transferred onto the transfer material.

13. An apparatus according to claim 1, wherein the latent image by said first electrostatic latent image forming means is formed in accordance with predetermined reference image information.

14. An apparatus according to claim 2, wherein the latent image by said second electrostatic latent image forming means is formed in accordance with predetermined reference image information.

15. An apparatus according to claim 1, wherein the detection by said detecting means and the control of the developing bias voltage by said control means in accordance with the detection are performed during non-image-forming operation.

16. An image forming apparatus, comprising:

movable image bearing means;

first charging means for charging said image bearing means;

first electrostatic latent image forming means for forming a first electrostatic latent image in accordance with image information on said image bearing means charged by said first charging means;

first developing means for developing the first electrostatic latent image;

second charging means for re-charging said image bearing means;

second electrostatic latent image forming means for forming a second electrostatic latent image in accordance with image information on said image bearing means re-charged by said second charging means;

second developing means for developing the second electrostatic latent image;

detecting means for detecting a surface potential of said image bearing means, said detecting means detecting at least the surface potential at that portion of a developed image formed on said image bearing means from the first latent image by said first developing means, after the portion is charged by said second charging means; and control means for controlling said second charging means to provide a target potential of said portion and for controlling a developing bias voltage of said second developing means in accordance with the potential of said portion.

17. An apparatus according to claim 16, wherein said control means further controls the developing bias voltage of said second developing means on the basis of a potential at that portion of the latent image formed on said image bearing means by said second electrostatic latent image forming means which is developed.

18. An apparatus according to claim 16 or 17, wherein said first and second electrostatic latent image forming means project pieces of light information in accordance with respective pieces of image information onto said image bearing means to form the electrostatic latent images.

19. An apparatus according to claim 18, wherein said pieces of light information are provided by laser beams modulated in accordance with the pieces of image information.

20. An apparatus according to claim 18, wherein said first and second electrostatic latent image forming means project light to that portion of said image bearing means which is to be developed, and wherein said first and second developing means performs reverse development wherein that portion of said image bearing means which is exposed to light is developed.

21. An apparatus according to claim 20, wherein the light is a laser beam modulated in accordance with image information.

22. An apparatus according to claim 20, said detecting means detects the potential of the portion exposed to the light by said electrostatic latent image forming means.

23. An apparatus according to claim 16, wherein said first charging means and said second charging means effect charging to the same polarity.

24. An apparatus according to claim 16, wherein said first charging means, a first latent image forming station for forming the latent image by said first electrostatic latent image forming means, said first developing means, said second charging means, a second latent image forming station for forming the latent image by said second electrostatic latent image forming means and said second developing means are disposed around said image bearing means in the order named.

25. An apparatus according to claim 24, wherein said image bearing means includes a rotatable member having an outer periphery movable along an endless path.

26. An apparatus according to claim 24, wherein said detecting means is disposed between said second latent image forming station and said second developing means.

27. An apparatus according to claim 16, wherein said first and second developing means contain different color developers, said apparatus further comprising transfer means for transferring first and second developed images onto a transfer material, wherein the first and second images are simultaneously transferred onto the transfer material.

28. An apparatus according to claim 16, wherein the latent image by said first electrostatic latent image forming means is formed in accordance with predetermined reference image information.

29. An apparatus according to claim 17, wherein the latent image by said second electrostatic latent image forming means is formed in accordance with predetermined reference image information.

30. An apparatus according to claim 16, wherein the detection by said detecting means and the control of the developing bias voltage by said control means in accordance with the detection are performed during non-image-forming operation.

31. An apparatus according to claim 1 or 16, wherein the developing bias voltage of said first developing means is controlled by said control means in accordance with potentials of the portion to be developed and the portion not to be developed, of the latent image formed by said first electrostatic latent image forming means.

* * * * *